United States Patent [19]

Shaub

[11] Patent Number: 4,769,965

[45] Date of Patent: Sep. 13, 1988

[54] METHOD AND APPARATUS OF POSITIONING A NEW CEILING OVER AN EXISTING CEILING

[75] Inventor: Melvin H. Shaub, Lancaster, Pa.

[73] Assignee: Armstrong World Industries, Inc., Lancaster, Pa.

[21] Appl. No.: 126,180

[22] Filed: Nov. 27, 1987

[51] Int. Cl.[4] ..... E04B 5/55

[52] U.S. Cl. ..... 52/488

[58] Field of Search ..... 52/484, 486, 488

[56] References Cited

U.S. PATENT DOCUMENTS

| | | | |
|---|---|---|---|
| 2,767,815 | 10/1956 | Brandstetter | 52/664 |
| 2,807,993 | 10/1957 | Ericson | 52/484 |
| 2,890,583 | 6/1959 | Grosskortenhaus | 52/484 |
| 3,055,466 | 9/1962 | Brown | 52/484 |
| 3,089,569 | 5/1963 | Shults | 52/484 |
| 3,100,319 | 8/1963 | Carlson | 52/488 |
| 3,251,164 | 5/1966 | Wright | 52/488 |
| 3,333,387 | 8/1967 | Deakins | 52/484 |
| 3,798,865 | 3/1974 | Curtis | 52/488 |
| 4,720,944 | 1/1988 | Loicq | 52/484 |

*Primary Examiner*—John E. Murtagh

[57] ABSTRACT

A runner system is provided to position a new ceiling over an existing ceiling and to position the new ceiling within a one inch space from the surface of the existing ceiling. A z-shaped runner is fastened to the existing ceiling and ceiling boards will rest on the horizontal flanges of the z-shaped runner. A cross-runner is also designed to rest upon the horizontal flanges of the z-shaped runner and an indentation and groove arrangement locks the cross-runners in position between the two adjacent main runners.

4 Claims, 2 Drawing Sheets

METHOD AND APPARATUS OF POSITIONING A NEW CEILING OVER AN EXISTING CEILING

BACKGROUND OF THE INVENTION

1. Field of the Invention

The invention is directed to a ceiling suspension system and, more particularly, to a ceiling suspension system that will position a new ceiling over an existing ceiling and with only an approximately one inch loss in ceiling height.

2. Description of the Prior Art

The fastening of runners to an existing ceiling is known in the art and cross-runners have been utilized therewith. The particularly inventive feature of the runner structure herein is the utilization of a locking means to position and hold the cross-runner in position relative to the main runner structure.

SUMMARY OF THE INVENTION

Two first or main runners are provided having a generally z cross-section. The upper flange of the runners are nailed to an existing ceiling and the lower flanges form the support for a ceiling board. At least one cross-runner of a conventional inverted T-shape is utilized and the cross-runner rests upon the horizontal flanges of the main runner. There is a notch provided in the upper end of the vertical web of the cross-runner and a projection is positioned on the nailing flange of the main runner so that the notch and projection will engage each other and hold the cross-runner in position between two main runners. The cross-runners are provided with an offset lip so that when the cross-runner lower flanges rest upon the lower flanges of the main runners, the bottom portion of the runners of both the main runner and the cross-runner are in the same plane.

The ceiling structure above permits the use of a method for positioning the cross runner in position between two main runners. A space is formed between the existing ceiling and the lower horizontal flanges of the main runners and this space is approximately one inch in size. The cross-runners are longer in length than the spacing between the ends of the flanges of two adjacent main runners. One end of a cross-runner is inserted into the space between the horizontal flanges of one main runner and the existing ceiling. This permits the other end of the cross-runner to move above the plane of the lower flange of the adjacent main runner. The cross-runner is now moved laterally so that the ends of the cross-runner may rest upon the horizontal flange of the main runners. A notch and groove locking arrangement locks the cross-runner in position so that it may not be accidentially moved laterally whereby one end of the cross-runner will drop away from the flange of the main runner.

BRIEF DFESCRIPTION OF THE DRAWING

DESCRIPTION OF THE PREFERRED EMBODIMENT

Figure 2:
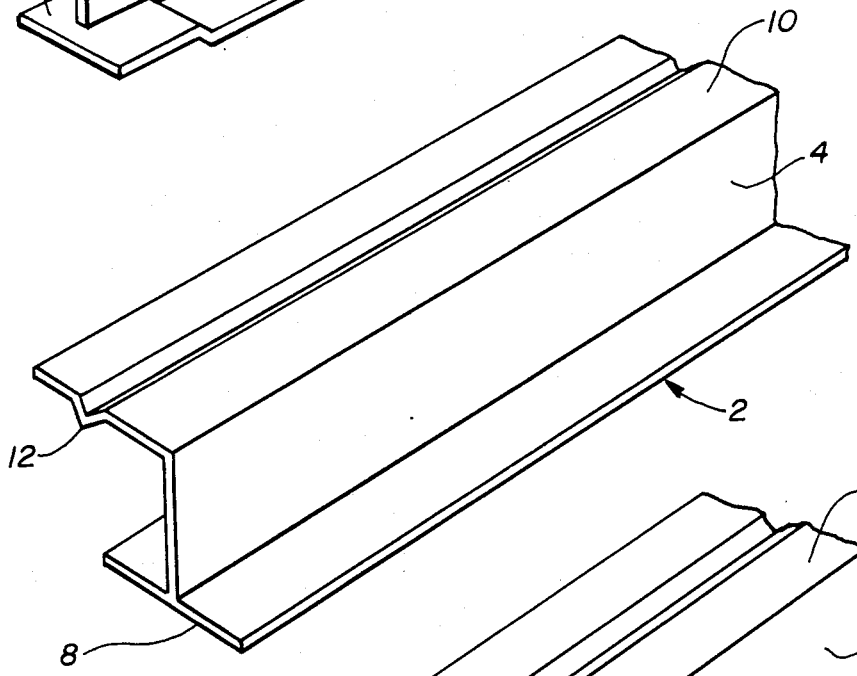
FIG. 2 is a perspective view of a main runner.
Figure 3:
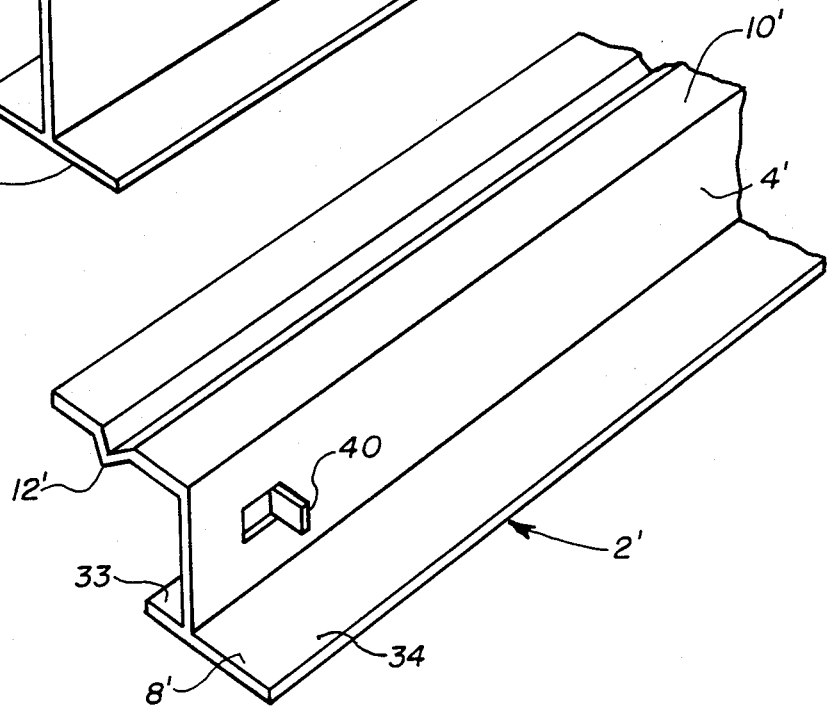
FIG. 3 is a perspective view of another embodiment of a main runner.

The ceiling system of the drawings comprises at least two first runners 2. Each first runner has a generally z cross-section, a vertical web 4, and, at the lower end of the vertical web, equal width horizontal flanges 8. The flanges extend either side of the vertical web perpendicular to the web. At the top of the vertical web 4 there is a single long upper horizontal flange 10 extending from one side of the vertical web perpendicular to the web. The single horizontal flange 10 is of a width greater than the width of a lower flange as measured from the vertical web 4 to the end of one portion of the horizontal flange extending to one side of the vertical web. This size difference can clearly be seen in FIG. 2. The upper flange 10 has a projection 12 near the end thereof extending therefrom in the direction towards the lower flange. The first runners or main runners are adapted to be fastened by nails 16 to the face of the an existing ceiling. As seen in FIG. 3, the existing ceiling would be primarily rafters 14 covered with some type of covering 15 which could be drywall or some other like material. The means 16 fastens the upper flange of the runner 2 to the existing ceiling with the lower flanges 8 of the first runner or main runner spaced approximately one inch from the surface of the existing ceiling and parallel to the face of the existing ceiling.

Figure 1:
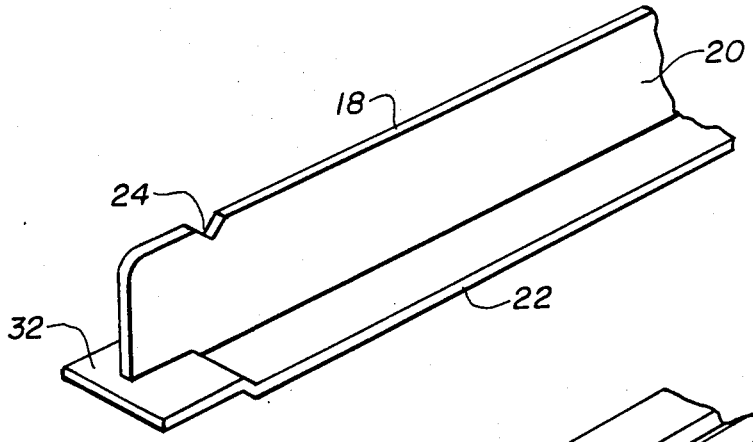
FIG. 1 is a perspective view of a crossrunner.

There is provided at least one cross-runner 18 which has an inverted T-shape. The cross-runner has a vertical web 20 with an upper and lower end. At the lower end of the vertical web, there is equal width horizontal flanges 22 extending either side of the vertical web parallel to the web. At the upper end of the vertical web, near each end thereof, there is positioned a notch 24. As seen in FIG. 3, a cross-runner is positioned between two adjacent first runners 26 and 28 with one end of the cross-runner resting on the lower flange of first runner 26 and the other end of the cross-runner resting on the lower flange of the adjacent first runner 28 with the notch on the right end of the cross-runner engaging the projection on the upper flange of first runner 28 whereby the projection and notch engagement holds the cross-runner in position between two adjacent runners. It can be seen in FIG. 8 also that the horizontal flanges of the first runner and naturally, the cross-runner will support the edge of a ceiling board 30. It can be seen in FIGS. 1 and 3 that the ends of the cross-runner rest on the lower flange of the first runners and that each end of the cross-runner is formed with an offset lip 32 so that the bottom of the main runner flange and the bottom of the cross-runner flange are in the eame plane.

Figures 4, 5, 6:
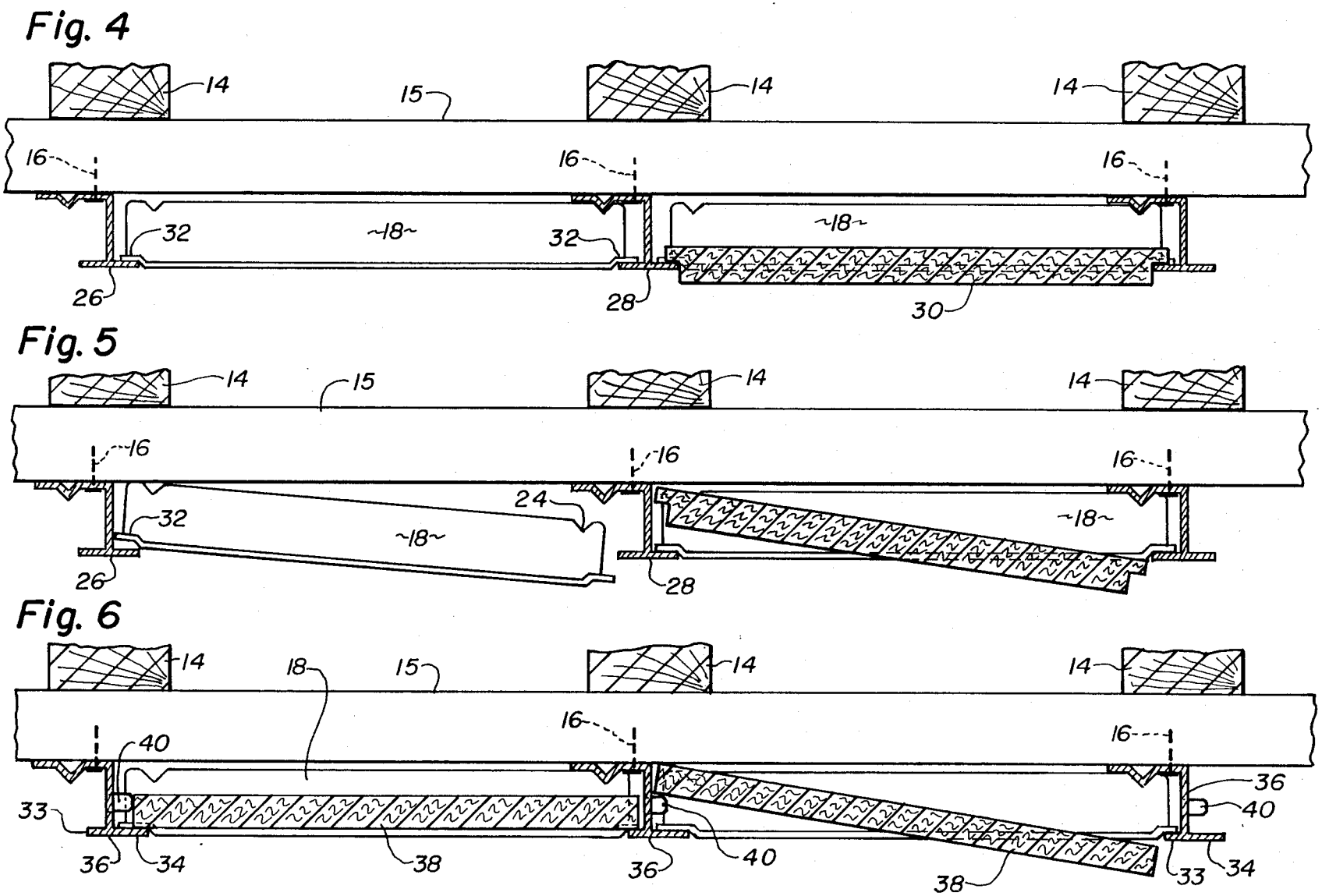
FIG. 4 is a cross-sectional view of an existing ceiling eyetem with the cross-runner and ceiling board in position.
FIG. 5 is a cross-section of an existing ceiling showing the cross-runner and ceiling board being positioned between two adjacent main runners.
FIG. 6 is a cross-section of another embodiment of the invention.

FIG. 4 shows the method of positioning a new ceiling over an existing ceiling. On the left side of FIG. 4, there is shown a cross-runner and on the right side of FIG. 4, there is shown a ceiling board. Both are mounted in position in the same manner. The overall length of the cross-runner or ceiling board is greater than the distance between the edge of the right lower flange of runner 26 and the edge of the left lower flange of runner 28. A space exists between flange 26 and the existing ceiling and this space is approximately one inch. One end of a cross-runner or a ceiling board is inserted into this space. This provides sufficient clearance for the other end of the cross-runner or ceiling board to clear the edge of the horizontal flange of the adjacent main runner 28. Once the edge of the lower flange of runner 28 is cleared, the cross-runner or ceiling board can be moved laterally left to right and the cross-runner or ceiling board is positioned as shown in FIG. 3.

Another embodiment of the invention is shown in FIG. 5. Unequal eize bottom flanges 33, 34 are shown on runner 36. The total width of the two flangee is the same as the width of the flanges of runner 28, but the sizes of the flanges 33, 34 are about $\frac{1}{3}$ total width and $\frac{2}{3}$ total width while runner 28 has equal width flanges.

The unequal flange width will permit the use of the standard flat ceiling board which will have its edges rest on the flanges. However, a means must be provided to keep the board from shifting laterally and falling out of the runner system. Ceiling board 80 is held in place since part of the edge of the board contacts the edge of the flanges upon which it rests (see FIG. 3). The same is true for cross-runner 18 (offset lips 32). with the flat board 38 in place on the right side of FIG. 5, a tab 40 will engage the side of the board 38 and keep it from shifting laterally out of the runner system. The tab 40 on the left side of the board and the web of the runner on the right side of the board will retain the board 30 on the flanges of the adjacent runners 36.

The flat board 38 is positioned on the runners as per the board 30 and cross-runner 18. The left edge of the board must be raised above and pass over tab 40 for the right edge of the board to clear the edge of the flange of the right runner.

What is claimed is:

1. A ceiling system comprising:

(a) at least two first runners each having a generally z cross-section, the first runner having a vertical web, at the lower end of the vertical web there being lower horizontal flanges extending either side of the vertical web perpendicular to the web, at the top of the vertical web there being a single long upper horizontal flange extending from one side of the vertical web perpendicular to the web, said single horizontal flange being of a width greater than the width of a lower flange thereunder, said upper flange having a projection near the end thereof extending therefrom in the direction of the lower flanges, said first runners being adapted to be fastened to the face of an existing ceiling by a means fastening the upper flange to the ceiling with the lower flanges spaced from and parallel to the face of the existing ceiling, (b) at least one cross-runner having an inverted T-shape, the cross-runner having a vertical web with an upper and lower end, and, at the lower end of the vertical web, there being equal width horizontal flanges extending either side of the vertical web perpendicular to the web, at the upper end of the vertical web near each end thereof there being positioned a notch; and (c) said cross-runner being positioned between two ajacent first runners with one end of the cross-runner resting on the lower flange of one first runner and the other end of the cross runner resting on the lower flange of the adjacent second first runner, the notch on at least one end of the cross runner engaging the projection on the upper flange of one of the two adjacent runners whereby the projection and notch engagement holds the cross runner in position between two adjacent runners.

2. A ceiling system as set forth in claim 1 wherein:

(a) said lower horizontal flanges of said cross-runner and first runners are of equal width and support the edges of a ceiling board

3. A ceiling system as set forth in claim 1 wherein:

(a) said cross-runner, on each end thereof, has the ends of the cross-runner resting on the lower flange of the first runners, and (b) said each end of the cross-runner being formed with an offset lip whereby the lip rests on the top of the horizontal flange of the first runner and the bottom of the first runner flange and bottom of the cross runner flange are in the same plane.

4. A ceiling system as set forth in claim 1 wherein, (a) said first runner has at least one tab extending from the vertical web thereof near the horizontal flanges which are of unequal width.

* * * * *